US008066086B2

(12) United States Patent
Haglund

(10) Patent No.: US 8,066,086 B2
(45) **Date of Patent: *Nov. 29, 2011**

(54) SLEEVE ARRANGEMENT

(75) Inventor: Jan Haglund, Karlskoga (SE)

(73) Assignee: Atlas Copco Rock Drills AB, Orebro (SE)

( * ) Notice: Subject to any disclaimer, the term of this patent is extended or adjusted under 35 U.S.C. 154(b) by 0 days.

This patent is subject to a terminal disclaimer.

(21) Appl. No.: 12/930,088

(22) Filed: Dec. 28, 2010

(65) Prior Publication Data

US 2011/0114390 A1 May 19, 2011

Related U.S. Application Data

(63) Continuation of application No. 11/658,383, filed as application No. PCT/SE2005/001415 on Sep. 27, 2005, now Pat. No. 7,861,804.

(30) Foreign Application Priority Data

Oct. 7, 2004 (SE) ..... 0402424

(51) Int. Cl.

| | |
|---|---|
| ***E21B 41/00*** | (2006.01) |
| ***E21B 7/02*** | (2006.01) |
| ***E21B 7/00*** | (2006.01) |
| ***G10K 11/02*** | (2006.01) |

(52) U.S. Cl. ..... 175/325.1; 175/424; 181/200

(58) Field of Classification Search ..... 173/DIG. 2; 175/162, 57, 325.1, 424; 181/198, 200; 166/75.11
See application file for complete search history.

(56) References Cited

U.S. PATENT DOCUMENTS 3,667,571 A * 6/1972 Fattelay ..... 181/230
7,861,804 B2 * 1/2011 Haglund ..... 175/325.1

FOREIGN PATENT DOCUMENTS

JP 60-32487 3/1985

* cited by examiner

*Primary Examiner* — Thomas Beach
*Assistant Examiner* — James Sayre
(74) *Attorney, Agent, or Firm* — Mark P. Stone

(57) ABSTRACT

Sleeve arrangement for a drill rig, especially adapted for damping sound and sealing to the ground, said drill rig comprising a feed beam (4) having a drill end (41) and a rear end (42), said feed beam (4) comprising a first and a second part (411, 412) near the drill end (41), the first part (411) near the drill end (41), the first part (411) being fixed in relation to the feed beam (4), and the second part (412) being movable in relation to the feed beam (4) in a longitudinal direction. The invention is characterized in that said sleeve arrangement comprises a first flexible element (100) attached to the first part (411), and a second flexible element (200) attached to the movable second part (412), such that said first and second flexible elements (100, 200) are movable in relation to each other, wherein said second flexible element (200) is capable of taking an upper and a lower position, as well as all positions therebetween.

8 Claims, 1 Drawing Sheet

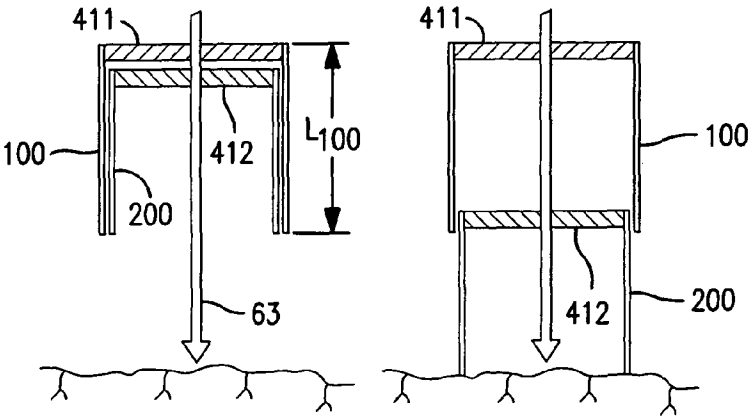
FIG. 2a
FIG. 2b
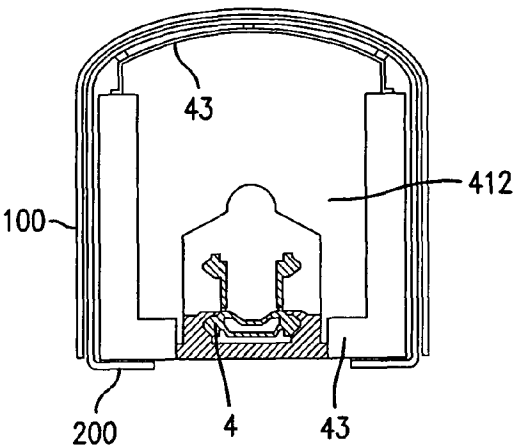
FIG. 3
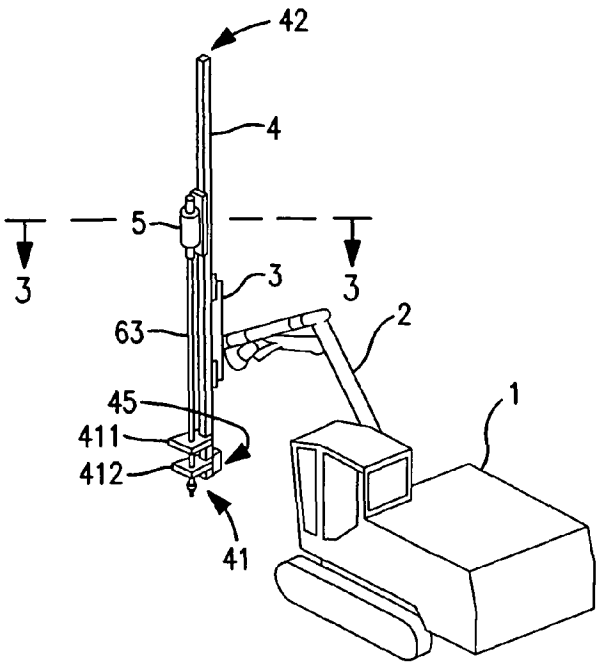
FIG. 1

SLEEVE ARRANGEMENT

The present application is a continuation of U.S. Ser. No. 11/658,383, filed on Jan. 23, 2007, and claims the benefit of said application under 35 U.S.C. Section 120; which is the U.S. National Phase of PCT/SE2005/001415, filed Sep. 27, 2005, pursuant to 35 U.S.C. Section 371; which claims priority from Swedish Patent Application 0402424-6, filed Oct. 7, 2004, pursuant to 35 U.S.C. Section 119(a).

TECHNICAL FIELD

Sleeve arrangement for a drill rig, especially adapted for damping sound and sealing to the ground, in accordance with the preamble of the independent claim. The present invention also relates to a drill comprising such sleeve arrangement.

BACKGROUND

Drilling equipment of different kinds generate sound, and especially heavy drill equipment such as rock drill rigs used for surface or underground drilling.

Generally, a rock drill rig (FIG. 1) comprises a movable carrier, a boom and a feed beam connected to the boom via e.g. a feed beam holder. The feed beam and the feed holder are movable in relation to each other along at least part of the length of the feed beam, to enable relative movement between the feed beam and the boom. A drilling machine is movable along the feed beam, affecting the drill string to be forced into the ground. The drill string comprises the drill point (drill bit) and the joined rods.

Disturbing sound is for instance generated at the drilling machine and at the drill point. It is therefore desirable to dampen the generated sound to the surroundings.

It is known a variety of different sleeves, arranged at the front part of a housing arrangement or feed beam, preventing sound and dust from spreading from the vicinity of the drill hole to the surroundings. These sleeves are often made of rubber or similar materials and arranged annularly around the drill string.

U.S. Pat. No. 3,667,571 discloses an arrangement forming a dust exhaust chamber of an inner truncated cone and an outer cylinder portion leaving an annular space in between. The chamber arrangement rests on the ground by way of two flanges.

WO00/39412 discloses an arrangement made of flexible bristles or strips sealing the one end of a housing to the ground.

WO02/070856 shows a flexible multipart sleeve for contact with the ground being attached to the lower part of a casing.

A problem with known sleeve arrangements is that they impede the visibility/view for the operator when putting the drill point in position. When the operator positions the feed beam with the drill equipment, these sleeves obstruct the view for the operator in the cabin. He/she might have to go out from the cabin to ensure the positioning which of course is time consuming, or even settle for a less favourable position which may result in fatal consequences.

BRIEF DESCRIPTION

The object of the invention is to sufficiently seal and dampen sound generated by the drilling machine at the drill point, and still give the operator visibility to put the drill point into position. This is solved by the features set forth in the characterizing portion of the independent claim.

Preferred embodiments are set forth in the dependent claims.

According to a main aspect, the present invention relates to a sleeve arrangement for a drill rig, especially adapted for damping sound and sealing to the ground, said drill rig comprising a feed beam having a drill end and a rear end, said feed beam comprising a first and a second part near the drill end, the first part being fixed in relation to the feed beam, and the second part being movable in relation to the feed beam in a longitudinal direction. The invention is characterized in that said sleeve arrangement comprises a first flexible element attached to the first part, and a second flexible element attached to the movable second part, such that said first and second flexible elements are movable in relation to each other, wherein said second flexible element is capable of taking an upper and a lower position, as well as all positions there between.

The advantage with the two flexible elements being movable in relation to each other is that the sleeve arrangement enables an adjustable connection to the ground surface. The sleeve arrangement creates a seal to the surroundings which enables dampening of sound and protection against spreading of dust and dirt, and at the same time gives the operator a possibility to monitor the working point and/or drill point at positioning of the same by way of the movability between the elements. The sleeve arrangement may be used for different feed beam angles and different inclines of site with good sealing effect.

These and other aspects of, and advantages with the present invention will be apparent from the detailed description and the accompanying drawings.

SHORT DESCRIPTION OF DRAWINGS

In the detailed description of the present invention reference will be made to the accompanying drawings, wherein FIG. 1 shows a schematic view of a rock drill rig, FIG. 2*a* shows a schematic view of the sleeve arrangement according to the invention, the second flexible element being in its upper position, FIG. 2*b* shows a schematic view of the sleeve arrangement according to the invention, the second flexible element being in its lower position, and FIG. 3 shows a schematic cross section of the invention taken along directional arrows 3-3 of FIG. 1.

DETAILED DESCRIPTION

FIG. 1 shows a schematic view of a rock drill rig comprising a movable carrier 1, a boom 2 and a feed beam 4 connected to the boom 2 via a feed beam holder 3. The feed beam 4 and the feed beam holder 3 are movable in relation to each other along at least part of the length of the feed beam 4. A drilling machine 5 is movably attached to the feed beam 4, and is movable along the feed beam 4 to affect the drill string 63. The drill string 63 comprises the drill point (drill bit) and the joined rods. Other equipment attached to the feed beam 4, may be equipment for e.g. rod handling, bolting, and loading of explosives.

The feed beam 4 has a drill end 41 from which the drill point protrudes at drilling, and a rear end 42 opposite the drill end 41. A first and a second part 411, 412 of the feed beam 4 are arranged near the drill end 41. The first part 411 being fixed in relation to the feed beam 4, and the second part 412 being movable in relation to the feed beam 4 in a longitudinal direction. The first and/or second parts 411, 412 may be constituted by drill guides or similar arrangements on the feed beam 4.

A first flexible element 100 is attached to the first part 411, and a second flexible element 200 is attached to the movable second part 412, such that said first and second flexible elements 100, 200 are movable in relation to each other. The second flexible element 200 is capable of taking an upper and a lower position (FIGS. 2*a* and 2*b*), as well as all positions there between.

The feed beam 4 is preferably equipped with control means 45 for controlling the position of the second part 412. For example, the control means is adapted to control the position of the second part 412, such that it may be moved to a position enabling inspection of the drill string 63, that position may e.g. correspond to the upper position of the second flexible element 200.

The flexible elements 100, 200 may be formed as sheets, bristles or straps of any suitable material such as e.g. rubber or plastics.

The second flexible element 200 is preferably movable inside the first flexible element. Thus the sleeve arrangement is arranged to enclose the part of the drill string 63 being between the ground surface and the first part 411 of the feed beam 4 (FIGS. 2*a* and 2*b*).

Each element 100, 200 may surround the drill string completely or partly (FIG. 3). Each element 100, 200 may be made in one piece or in multiple parts overlapping each other.

According to a preferred embodiment, the length $L_{100}$ of the first flexible element 100 is such that the first flexible element 100 preferably entirely overlaps the second flexible element 200 when the second flexible element 200 is in its upper position (FIG. 2*a*), and such that the first flexible element 100 partly overlaps the second flexible element 200 when the second flexible element 200 is in the lower position (FIG. 2*b*). Thus, the upper position of the second flexible element 200 enables possibility to inspect the drill string 63. Nevertheless, it is, according to another embodiment, possible that the second flexible element 200 protrudes somewhat from the first flexible element 200 when the second flexible element 200 is in its upper position (not shown).

The first and second flexible elements 100, 200 may be releasably attached to the respective parts 411, 412 via frame means 43 (FIG. 3), such that the flexible elements can be exchanged if broken or worn out.

The second part 412 is preferably constituted by a movable drill guide.

When preparing a drilling operation, the drill rig carrier 1 is moved to the site/object where the drilling shall be performed. The feed beam 4, with the drilling machine 5, is aligned over the working point by assistance of the boom 2 and the feed holder 3. The movable second part 412 of the feed beam 4 is initially located adjacent to the first part 411. The first flexible element 100 entirely overlaps the second flexible element 200 (upper position, FIG. 2*a*). Thus, the first and second flexible elements 100, 200 leave the drill point visible for the operator during positioning.

Then, the second part 412 is moved towards the working point, and the second flexible element 200 will project from the first flexible element 100 to finally lie close to the ground. The first flexible element 100 partly overlaps the second flexible element 200 (lower position, FIG. 2*b*). The flexibility of the elements 100, 200 enables the invention to shape itself to the rock surface. The drill point connected to the first drill rod is forced into the ground by the drilling machine 5, while generating sound and spreading of dust/dirt.

Thus, the sleeve arrangement according to the invention constitutes a sealing that prevents the sound and dirt from spreading to the surroundings, and simultaneously enables a possibility to monitor the part of the drill string being just above the ground.

The sleeve arrangement may be used for different feed beam angles and different inclines of site with good sealing effect.

The sleeve arrangement may have sealing inlet connections for hoses/cables for e.g. electricity, air, oil, water and dust collection.

The embodiments shown in the drawings and put forward in the description should not be considered restricting, only as exemplifying.

The invention claimed is:

1. Sleeve arrangement for a drill rig, especially adapted for damping sound and sealing to the ground, said drill rig comprising a feed beam (4) having a drill end (41) and a rear end (42), said feed beam (4) comprising a drill string (63) and a first and a second part (411, 412) arranged near the drill end (41), the first part (411) being fixed in relation to the feed beam (4), and the second part (412) being movable in relation to the feed beam (4) in a longitudinal direction along the drill string (63), characterized in that a first flexible sleeve element (100) is attached to the first part (411), and a second flexible sleeve element (200) is attached to the second part (412), the second part (412) is adapted to move inside the first flexible sleeve element (100) and the first flexible sleeve element (100) is adapted to at least partly overlap the second flexible sleeve element (200), and the second flexible sleeve element (200) is capable of assuming an upper and a lower position, as well as all positions therebetween and thereby enabling inspection of the drill string (63) as well as enabling an adjustable connection to the ground surface, the feed beam (4) being equipped with control means for selectively controlling the position of the second part (412) relative to the first part (411).

2. Sleeve arrangement according to claim 1, characterized in that said control means is adapted to control the position of the second part (412), such that it may be moved to a position enabling inspection of the drill string (63), said inspection position including a position corresponding to the upper position of the second flexible sleeve element (200).

3. Sleeve arrangement according to claim 1, characterized in that the second flexible sleeve element (200) is movable inside the first flexible sleeve element (100).

4. Sleeve arrangement according to claim 1, characterized in that said sleeve arrangement is arranged to enclose the part of the drill string (63) being between the ground surface and the first part (411) of the feed beam (4).

5. Sleeve arrangement according to claim 1, characterized in that the length (L100) of the first flexible sleeve element (100) is such that the first flexible sleeve element (100) entirely overlaps the second flexible sleeve element (200) when the second flexible sleeve element (200) is in the upper position, and such that the first flexible sleeve element (100) partly overlaps the second flexible sleeve element (200) when the second flexible sleeve element (200) is in the lower position.

6. Sleeve arrangement according to claim 1, characterized in that the first and second flexible sleeve elements (100, 200) are releasably attached to the respective first and second parts (411, 412) via frame means (43).

7. Sleeve arrangement according to claim 1, characterized in that the second part (412) comprises a movable drill guide.

8. Drill rig comprising a sleeve arrangement according to claim 1.

* * * * *